US006064742A

United States Patent [19]

Landelius

[11] Patent Number: 6,064,742

[45] Date of Patent: May 16, 2000

[54] AUDIO IMPEDANCE/CALCULATED POWER METER

[75] Inventor: Lennart B. Landelius, Brookfield, Conn.

[73] Assignee: Gold Line Connector, Inc., West Redding, Conn.

[21] Appl. No.: 08/905,521

[22] Filed: Aug. 4, 1997

[51] Int. Cl.[7] ..... H04R 29/00

[52] U.S. Cl. ..... 381/58; 381/59

[58] Field of Search ..... 381/58, 59; 324/600, 324/713, 76.11, 142

[56] References Cited

U.S. PATENT DOCUMENTS 4,061,891 12/1977 Pommer ..... 324/142

4,870,341 9/1989 Pihl et al. ..... 324/600

*Primary Examiner*—Forester W Isen
*Assistant Examiner*—Brian Tyrone Pendleton
*Attorney, Agent, or Firm*—J. E. McTaggart

[57] ABSTRACT

For audio professionals, sound contractors, installers and the like, a hand-held electronic instrument facilitates analyzing and optimizing speaker systems or portions thereof which may include anything from a single speaker to transmission lines of a field-installed distributed system. The instrument measures and displays impedance in ohms on a numeric readout and additionally calculates power based on a designated audio line voltage, as user-selected by a panel switch, e.g. from 25, 50, 70 or 100 volts, and displays the calculated power in watts, based on measured load current at a constant applied. The test frequency can be user-selected by a panel switch, e.g. to 100, 330, 1k or 10k Hz.

1 Claim, 6 Drawing Sheets

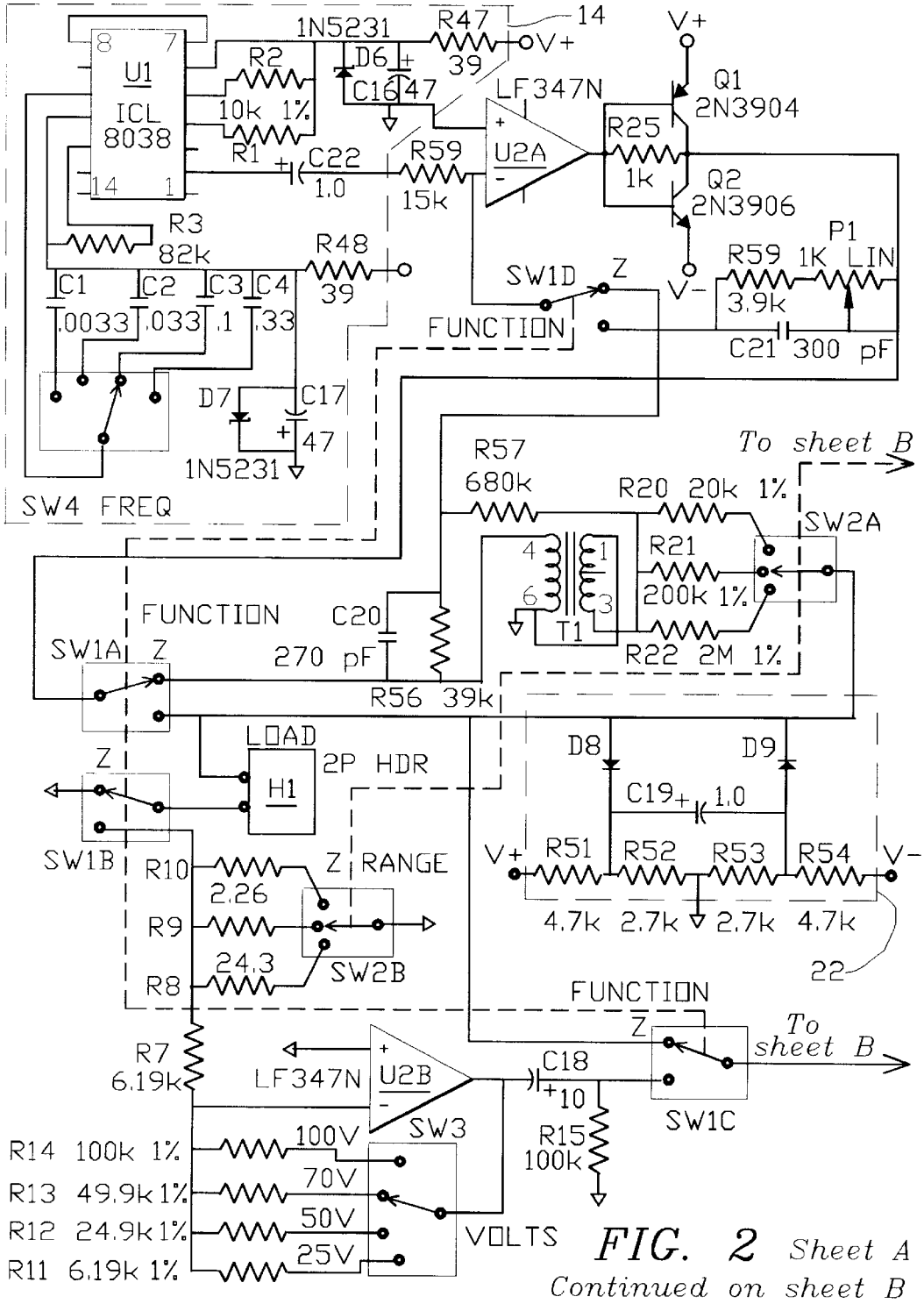
*FIG. 2* Sheet A
Continued on sheet B

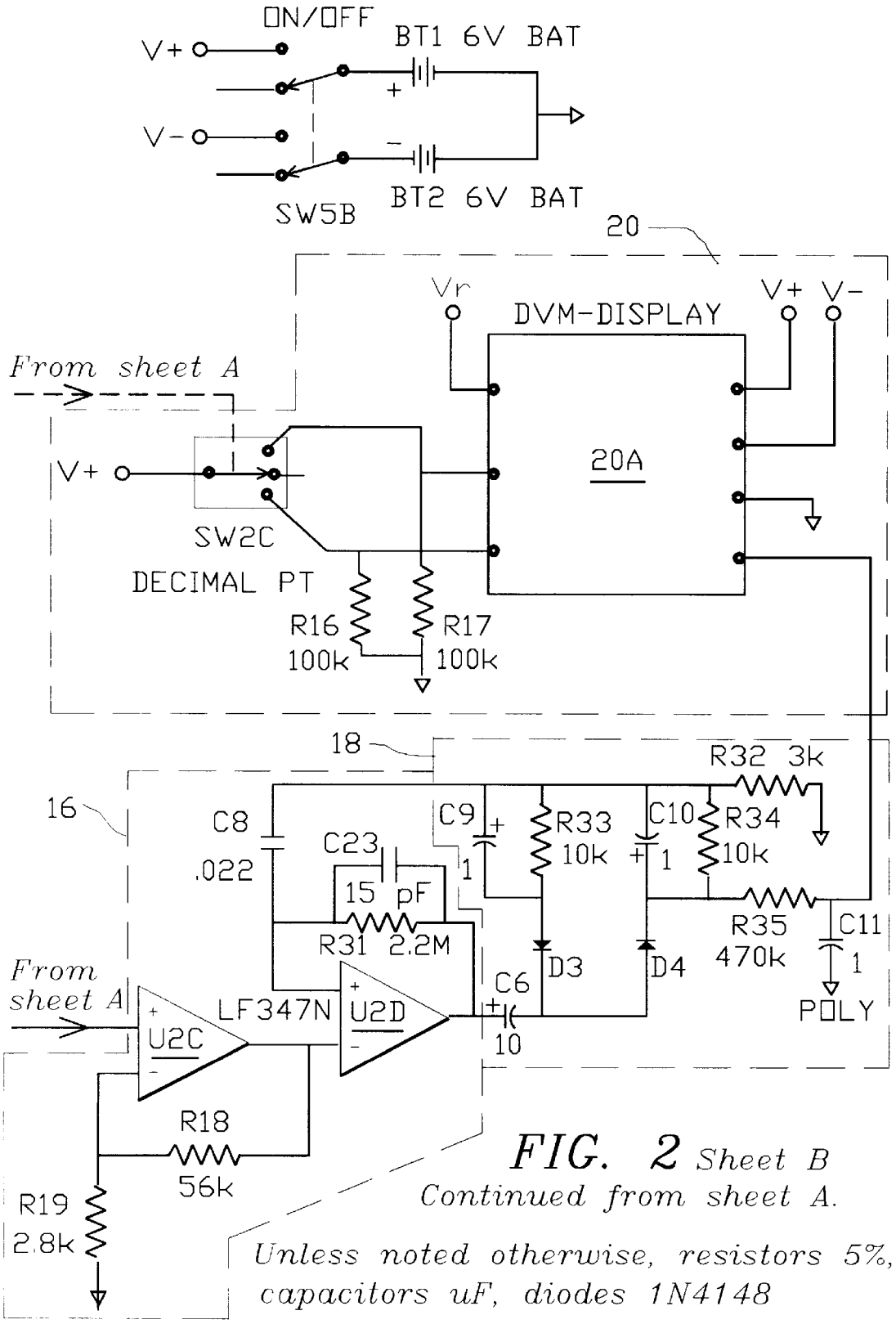
*FIG. 2* Sheet B
Continued from sheet A.
Unless noted otherwise, resistors 5%, capacitors uF, diodes 1N4148

AUDIO IMPEDANCE/CALCULATED POWER METER

FIELD OF THE INVENTION

The present invention relates to the field of electronic measurement equipment, and more particularly it is directed to a hand-held instrument for facilitating field analysis and optimization of multiple loudspeakers in distributed sound systems by providing the capability of measuring and displaying the impedance of a load and of the additional capability of calculating and displaying the audio power level that the load would receive from an audio line of a rated voltage.

BACKGROUND OF THE INVENTION

In the practice of professional audio, setting up and maintaining multiple speakers in a sound distribution system, whether indoors or outdoors, presents recurring problems of determining whether the available audio power is distributed in a optimal manner amongst the numerous speakers. Individual speakers are rated for impedance in ohms, as measured at a specified audio frequency, e.g. 330 Hz or 1 kHz. Multiple speakers are commonly combined in a group connected in series, parallel or in a series-parallel network., In a systematic approach, the system may be fed through one or more audio transmission lines for which a standard line voltage is specified. Individual speakers and/or speaker groups may be connected in parallel across the line at various points along the line. A transformer may be used with each speaker, speaker group and/or at each speaker tapoff along the line to balance the power level in each speaker. Standard line voltage levels have been established, e.g. 70.7 volts for high powered outdoor public address systems and 25 volts for indoor speaker systems such as in public schools.

Typically the impedance of speakers is predominantly resistive at the low frequency end of the audio spectrum and predominantly reactive (inductive) at the high frequency end.

A sound professional working in this field is primarily concerned with power distribution and needs to be able to quickly determine how much power will reach a load unit connected across the voltage-rated line. Due to present unavailability of cost-effective test equipment particularly dedicated to this problem, such professionals have had to settle for the conventional practice of making measurements with an impedance meter and then performing the additional step of calculating power from each impedance measurement, using a hand calculator or other means.

DISCUSSION OF RELATED KNOWN ART

In U.S. Pat. No. 4,061,891 to Pommer, disclosing a TEST INSTRUMENT FOR DETERMINING APPARENT POWER CONSUMPTION AND GROUND FAULTS IN VARIOUS PORTIONS OF A DISTRIBUTED-LOAD, CONSTANT VOLTAGE AUDIO DISTRIBUTION SYSTEM, novelty is claimed for a voltage-controlled amplifier processing the oscillator signal in a feedback loop and a test procedure that calls for applying a constant voltage and monitoring current flow, and wherein measured results are displayed on a calibrated analog meter: While this instrument generally addressed the same problem as the present invention, it was limited at that time by technology, e.g. use of an analog meter because numeric readouts had not yet emerged as commercially viable. Although there was intent to make the Pommer instrument "portable", it was basically a "bench top" type instrument that fell far short of the convenience of a hand-held instrument that has become essential in this field as practiced at the present time. The absence (or at least obscurity) of the Pommer instrument in the present marketplace may be attributed to excessive cost, bulk and complexity factors related to contemporary technological limitations.

OBJECTS OF THE INVENTION

It is a primary object of the present invention to provide improvements in electronic instrumentation for use in professional sound activities, and particularly for estimating the power level of individual speakers and/or groups of speakers in distributed sound systems.

It is a further object to provide an audio measuring instrument in hand held form that displays results on a numeric readout and that has the capability of displaying impedance readings and power as calculated from a user-selectable voltage level.

SUMMARY OF THE INVENTION

The abovementioned objects have been accomplished by the present invention of a hand-held electronic instrument, with a numberic display panel, that operates in two modes: an OHMS mode which determines and displays the impedance of a load unit under test, typically a loudspeaker system or portion thereof, and a WATTS mode which determines and displays the calculated power in the load unit at a standard voltage that is user-selectable from a group of commonly-used standard audio line voltage levels: e.g. 25, 50, 70 and 100 volts. The audio test frequency is user-selectable from a group, e.g. 100 Hz, 330 Hz, 1 kHz and 10 kHz.

Impedance is determined by connecting a high value resistor in series with the load unit under test, applying a relatively high voltage to the series combination, monitoring the voltage developed across the load unit, and scaling the monitored voltage to display the impedance value directly in ohms.

Calculated power is determined by connecting a low value resistor in series with the load unit, applying a known voltage across the series combination, monitoring the voltage developed across the resistor and then scaling the monitored voltage to display the calculated power value directly in watts.

BRIEF DESCRIPTION OF THE DRAWINGS

The above and further objects, features and advantages of the present invention will be more fully understood from the following description taken with the accompanying drawings in which:

FIG. 2 is a schematic diagram of a major portion of the circuitry of the instrument of FIG. 1.

DETAILED DESCRIPTION

Figure 1:
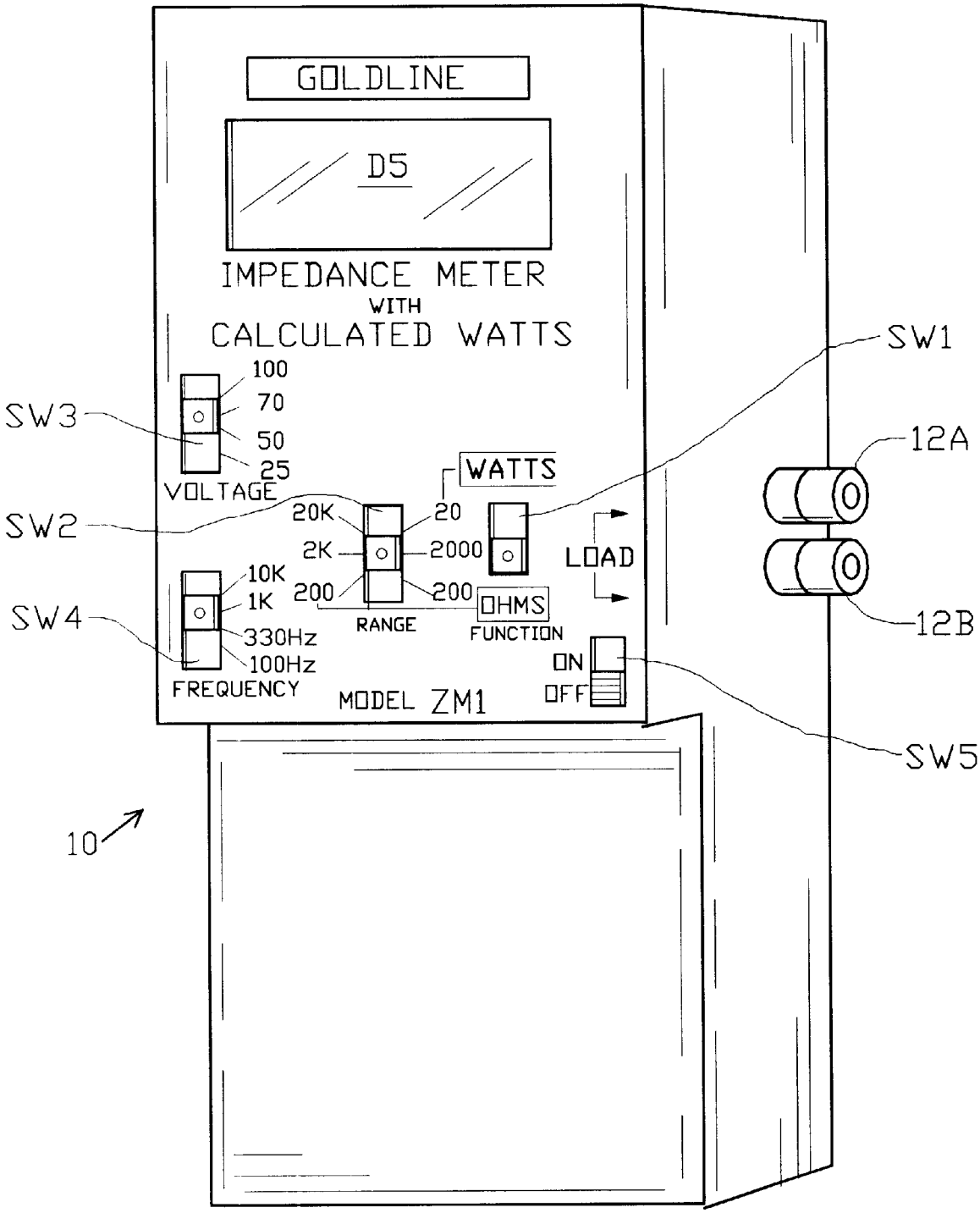
FIG. 1 is a three-dimensional representation of the external appearance of an audio frequency instrument in accordance with the present invention in a preferred embodiment for measuring and displaying impedance and calculated power.

FIG. 1 is a three dimensional representation depicting a hand-held audio instrument 10 according to the present invention in a preferred embodiment for measuring impedance and calculated power at a selected audio line voltage level and at a selected test frequency, and displaying the results on a numeric readout panel D5.

Load terminals 12A and 12B are provided for connecting to the load unit under test, typically one or more speakers in a sound system which may include matching transformers.

A function switch SW1 provides selection between the impedance measuring mode, labled OHMS, and the calculated power mode, labled WATTS.

The three-position range switch SW2 shifts the decimal point of readout panel D5 and also optimizes the measurement circuitry for accuracy and resolution in both the OHMS and WATTS modes.

Frequency selector switch SW4 provides a choice from four test frequencies: 100 Hz, 330 Hz, 1 kHz or 10 kHz.

In the WATTS mode, range switch SW3 provides a choice from four audio system voltage levels: 25, 50, 70 or 100 volts. The 25 volt level is standard in school audio systems and the 70 volt level (technically 70.7 ohms) is the general standard for outdoor sound reinforcement. The 50 and 100 volt levels are sometimes found in special systems.

FIG. 2 is a detailed schematic diagram of the instrument of FIG. 1. The circuitry operates from +/−6 Volts from a pair of batteries BT1 and BT2 as shown in the upper right region of FIG. 2. The audio signal generator unit 14 shown in dashed outline in the upper left region of FIG. 2, and three blocks in the lower right region, display amplifier 16, rectifier unit 18 and display system 20, are utilized in an identical manner in both modes: OHMS and WATTS.

Audio signal generator unit 14 is based on a frequency synthesizer chip U1, IC type L8038: its frequency is made selectable in four steps by switch SW4 and capacitors C1–C4.

Display amplifier 16, utilizing op-amps U2C and U2D in IC type LF347N, drives rectifier unit 18 containing diodes D3 and D4 and associated components C6, C9, C10, R33 and R34. The rectified output, filtered by R35 and C11, drives the display unit 20A, in which decimal point switching is accomplished by section SW2C of the three-position panel switch SW2. Two other two sections of SW2, located outside of display system 20, are shown connected by a dotted line.

The load unit under test, connected to terminals 12A and 12B (FIG. 1), is connected to the circuitry in FIG. 2 via terminals 1 and 2 of a 2 pin header LOAD H1 on the circuit board, shown in the lower left region of FIG. 2. Also connected between terminal 12A and ground is a diode limiter 22 comprising diodes D8 and d9, resistors R51–54 and capacitor C19, connected as shown to limit any voltage beyond about +/−2.8 volts. Limiter 22 serves to protect the measurement circuitry against high level transients or interference, both internal and external, e.g. noise from long audio lines, in both modes, OHMS and WATTS.

Figure 3:
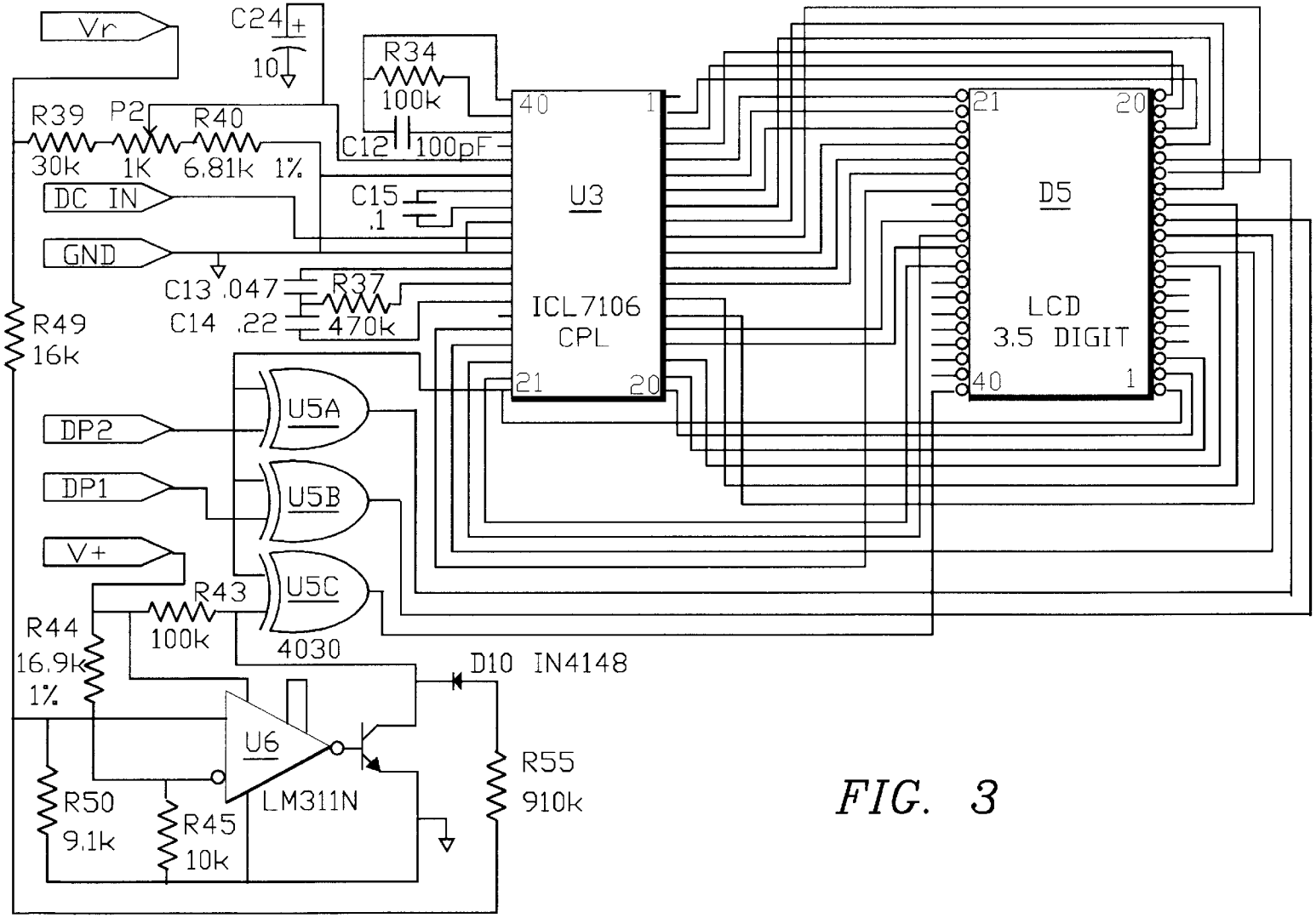
FIG. 3 is a schematic diagram of the display portion of FIG. 2.

FIG. 3 is a detailed schematic diagram of display unit 20A, which is of the type commonly utilized in popular DVM's (digital voltmeters). The display panel D5 is a 3½ digit LCD type; it is controlled from driver U3, IC type L7106CPL, and gates U5A–C, IC type 4030, connected to control inputs of driver U3. The display drive is the analog voltage received at terminal Vr at the upper left and delivered to driver U3 via series resistor R39 and gain trimmer potentiometer P2.

Figure 4:
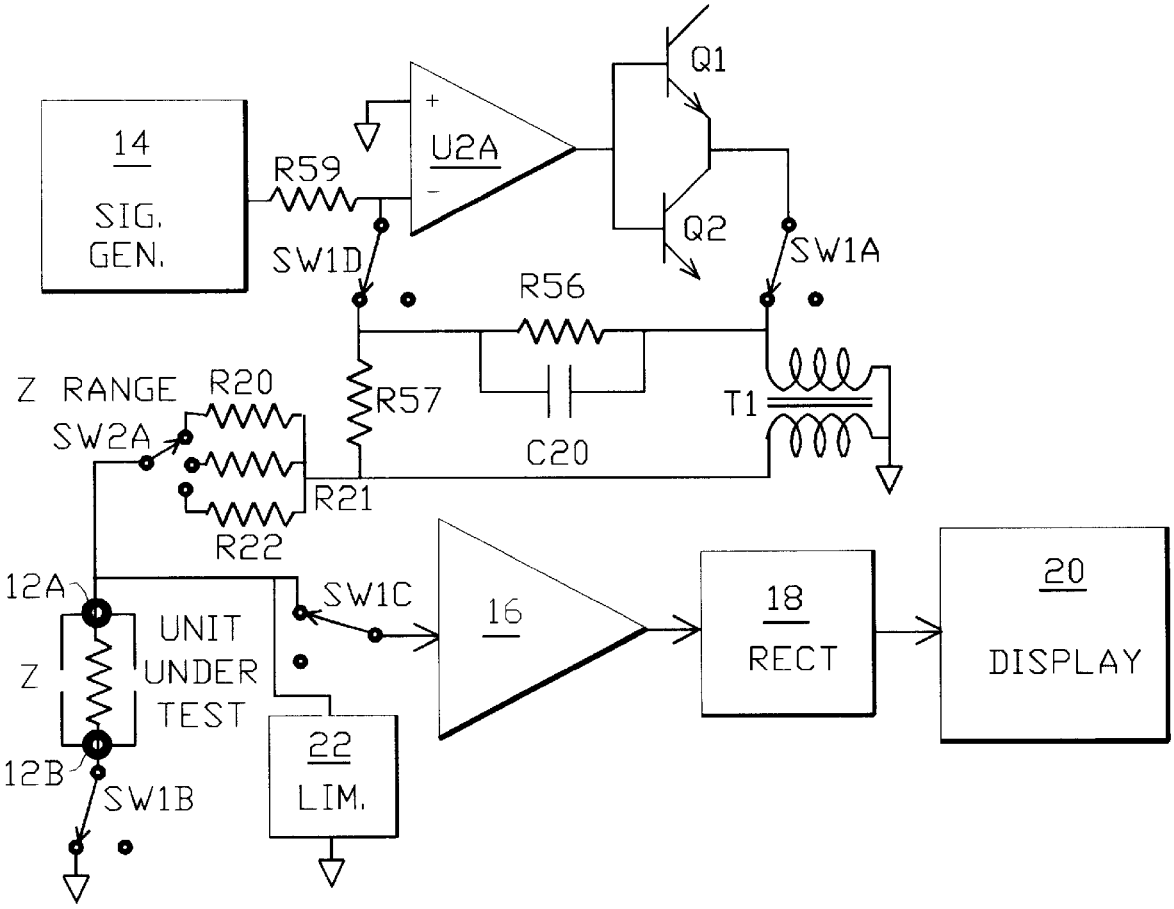
FIG. 4 is a functional block diagram/schematic of the instrument of FIGS. 1–3 showing the circuit configuration when the instrument is operated to the OHMS mode.
Figure 5:
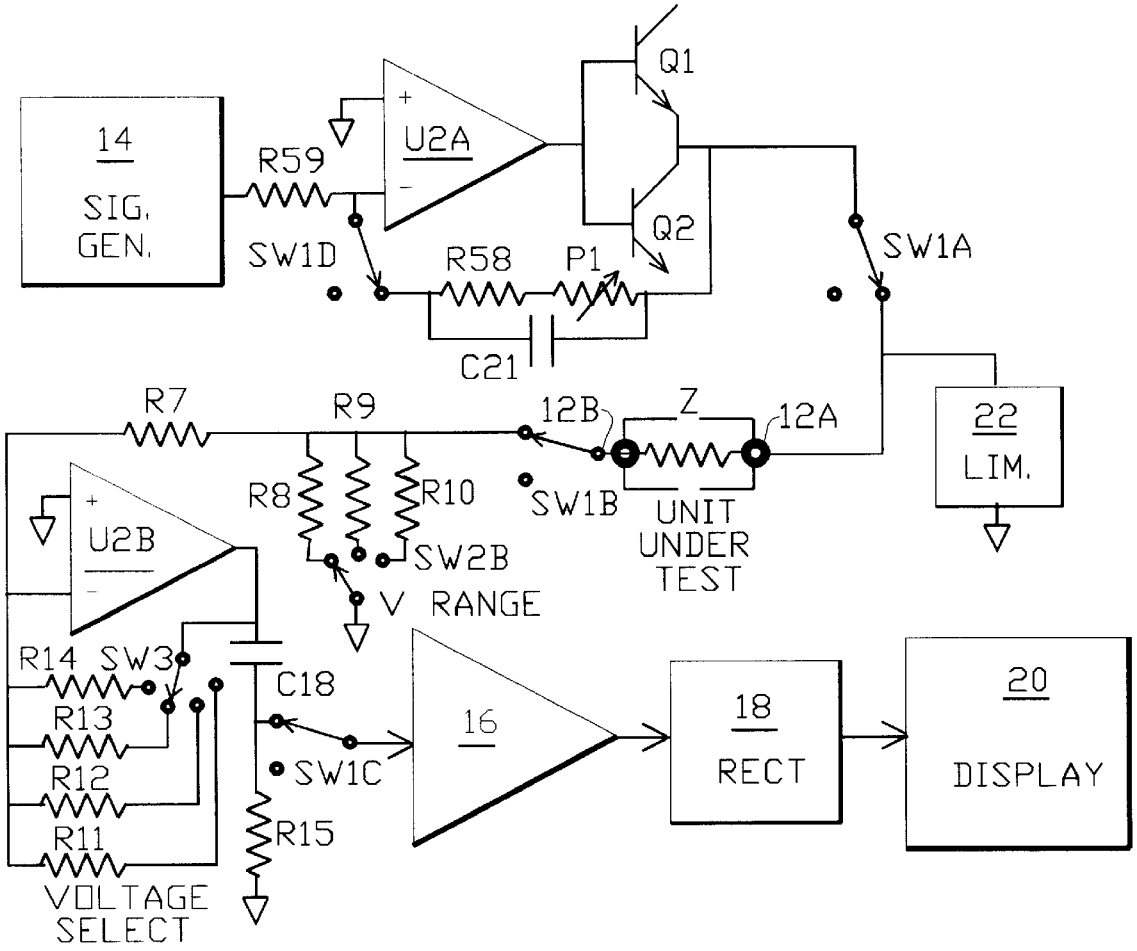
FIG. 5 is a functional block diagram/schematic of the instrument of FIGS. 1–3 showing the circuit configuration when the instrument is operated in the WATTS mode.

In FIGS. 4 and 5, audio signal generator 14, display amplifier 16, rectifier 18 and display system 20 are shown as functional blocks: these blocks are utilized in common for both modes, OHMS and WATTS, and are identical in both figures.

FIG. 4 shows the circuitry for measuring impedance when the mode switch SW1 is set to the OHMS mode with switch sections SW1A–D set as shown. The test signal from generator 14 is applied via resistor R59 to amplifier U2A which drives audio transformer T1 via transistor stack Q1, Q2. Transformer T1 steps up the test signal amplitude to about 70 volts at the secondary, which is applied through a current metering resistor, R20–22 as selected by the Z RANGE switch SW2A, thence through Z, the load unit under test, to ground. Using this high voltage source and correspondingly high value of the current metering resistor R20–22 acts to preserve measurement accuracy and to "swamp" unwanted noise or interference that can appear at the key measurement circuit node, terminal 12A, especially when it is connected to installed audio lines.

Thus, in the OHMS mode, with a known current applied to the load unit under test, the voltage (V=I*Z) developed across this load is proportional to the load impedance Z, therefore Z can be indicated numerically by designing the display unit 20 to have a correct scaling factor and decimal point location.

FIG. 5 shows the circuitry for determining calculated power when the mode switch SW1 is set to the WATTS mode so that switch sections SW1A–D are set as shown. The test signal from generator 14 is applied via resistor R59 to amplifier U2A as in FIG. 4, however, in the WATTS mode, the negative feedback branch for U2A becomes resistor R58 plus gain adjustment pot P1 with C21 across the two series elements. The generator signal, delivered at a controlled constant test voltage Vt from Q1 and Q2, is applied to terminal 12A of the load unit under test whose opposite end is now connected at terminal 12B in series with a low value current sampling resistor, as selected from R8–R10 by the V RANGE section SW2B of the three position range switch SW2, the other end of the sampling resistor returning to ground. A preamplifier U2B, driving the input of display amplifier 16, monitors the voltage developed across the sampling resistor, R8–10, representing current in the load impedance Z. The gain of preamplifier U2B is set by the negative feedback division between R7 and R11–14 as selected by the VOLTAGE switch SW3.

The voltage Vs developed across the selected sampling resistor (R8–10), in series with the load, is inversely proportional to the load impedance Z. Preamp U2B acts as an analog computer to calculate the estimated power from the equation $Pe=Vn^2/Z$ where Vn is the nominal audio line voltage. The term $Vn^2$ is provided by the properly selecting of the value of feedback resistors R11–14 to set the gain of preamp U2B as a constant scaling factor for each power range, while Vs yields term 1/Z as described above, thus the display unit is easily calibrated to indicate the estimated power Pe directly in watts.

The particular circuit details shown in FIGS. 2–5 represent a particular embodiment of the invention disclosed herein to illustrate a preferred and practical example of making and practicing the invention. There are many variations available to those of skill in the electronics arts to utilize the principles of the invention in modified form, and to implement the functions of various circuit blocks with components and component values different from those shown.

It would be a matter of design choice to provide more or less ranges in any or all of the three front panel user-selectable switch functions.

Particular functions that the inventor has chosen to implement with analog technology, e.g. the means for measuring Z and calculating Pe and displaying Z or P, could be implemented entirely or partially by known digital technology to emulate the corresponding functions of the disclosed embodiment.

Furthermore it would be within the scope of present day technology to further automate the operation of this relatively simple instrument with a tradeoff in added cost and complexity, for example by introducing known techniques of DVM autoranging to eliminate the need for the range switch SW2.

This invention may be embodied and practiced in other specific forms without departing from the spirit and essential characteristics thereof. The present embodiments therefore are considered in all respects as illustrative and not restrictive. The scope of the invention is indicated by the appended claims rather than by the foregoing description. All variations, substitutions, and changes that come within the meaning and range of equivalency of the claims therefore are intended to be embraced therein.

What is claimed is:

1. A compact hand-held electronic measuring instrument, operating in an audio frequency range, comprising;

a pair of test terminals connecting said measuring instrument to an external audio load under test;

an audio signal generator configured and arranged to generate an audio test signal;

a four-position frequency selector switch configured and arranged in conjunction with said signal generator to enable user selection of a test frequency from a plurality of available frequencies including 100 Hz, 330 Hz, 1 kHz and 10 kHz;

a two-position mode selector switch configured and arranged to select between an OHMS mode and a WATTS mode;

display means constructed and arranged to visually display measurement results in each of the two modes;

an audio impedance measuring circuit configured and arranged to measure impedance of the audio load under test at a selected one of the test frequencies, so as to implement the OHMS mode, including constant current means made and arranged to cause a reference alternating current of designated amplitude at a selected one of the test frequencies to flow through the load under test, so as to produce a developed voltage across the load, proportional to measured impedance of the load;

display driver means configured, arranged and calibrated to drive said display means from the developed voltage across the load in a manner to provide a visual indication of the measured impedance of the load;

a three-position impedance/power range selector switch configured and arranged in conjunction with said impedance measuring circuit and said power estimating circuit to enable user selection of impedance measurement range from three ranges selected from a group including 200, 2k and 20k, when said two-position mode selector switch is set to the OHMS mode, and to provide a selection from three power ranges, in a group including 20 watts, 200 watts and 2000 watts, when said two-position mode switch is set to the WATTS mode;

a power-estimating circuit configured and arranged to perform a measurement on the audio load and to therefrom calculate an estimated power that would be dissipated in the load, upon application of a designated nominal audio line voltage Vn at the predetermined frequency, so as to implement the WATTS mode, said power-estimating circuit comprising:

a constant voltage source made and arranged to apply a reference AC voltage of designated amplitude at a selected one of the test frequencies to the load under test, so as to produce a test current in the load inversely proportional to impedance of the load, said constant voltage source including a plurality of resistors of different predetermined low resistance values chosen so as to each provide a designated power indication range when connected in series between the load and the constant voltage source;

a current-sensing circuit comprising a resistor of predetermined low resistance value connected in series between the load and the constant voltage means made and arranged to provide a test signal representing amplitude of the test current and thus inversely proportional to the impedance of the load;

a user-operable power range selector switch made and arranged to select and connect one of said plurality of resistors in series between the load and the constant voltage means so as to set said measuring instrument to a desired estimated power range selected from a group that includes 20 watts, 200 watts and 2000 watts;

said display driver means and said display means being further configured, arranged and calibrated to provide a visual indication of estimated power Pe in the load as calculated from $Pe=Vn^2/Z$ where factor $Vn^2$ is provided as a range-switchable calibrated gain parameter in the display driver means and factor 1/Z is provided by the test signal.

* * * * *